US007396010B2

(12) United States Patent
Naruoka et al.

(10) Patent No.: US 7,396,010 B2
(45) Date of Patent: Jul. 8, 2008

(54) TAKE-OUT APPARATUS

(75) Inventors: Yoshihiko Naruoka, Kanagawa-ken (JP); Yukio Asari, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 12 days.

(21) Appl. No.: 10/438,888

(22) Filed: May 16, 2003

(65) Prior Publication Data

US 2004/0245698 A1 Dec. 9, 2004

(30) Foreign Application Priority Data

May 28, 2002 (JP) ..... P2002-154428

(51) Int. Cl.
*B65H 1/02* (2006.01)

(52) U.S. Cl. ..... 271/149

(58) Field of Classification Search ..... 271/10.11, 271/149, 150, 126, 152, 153
See application file for complete search history.

(56) References Cited

U.S. PATENT DOCUMENTS

| | | | | |
|---|---|---|---|---|
| 3,598,400 | A | 8/1971 | Nelson | |
| 4,566,685 | A * | 1/1986 | Irvine et al. | 271/150 |
| 4,919,412 | A * | 4/1990 | Weigel et al. | 271/110 |
| 5,092,574 | A * | 3/1992 | Braen et al. | 271/2 |
| 5,104,109 | A * | 4/1992 | Kubo | 271/3.12 |
| 5,224,695 | A * | 7/1993 | Svyatsky et al. | 271/110 |
| 5,335,899 | A * | 8/1994 | Golicz | 271/34 |
| 5,547,181 | A * | 8/1996 | Underwood | 271/114 |
| 5,882,002 | A * | 3/1999 | Kamei et al. | 271/118 |
| 5,988,628 | A * | 11/1999 | Mori | 271/117 |
| 6,032,946 | A * | 3/2000 | Marshall et al. | 271/152 |
| 6,155,556 | A * | 12/2000 | Lynch et al. | 271/117 |
| 6,217,020 | B1 * | 4/2001 | Supron et al. | 271/149 |
| 6,267,369 | B1 | 7/2001 | Regimbal et al. | |

FOREIGN PATENT DOCUMENTS

| | | | |
|---|---|---|---|
| DE | 3723589 | * | 1/1989 |
| EP | 0900751 | A1 | 3/1999 |
| EP | 0906880 | A1 | 4/1999 |
| EP | 1127817 | A2 | 8/2001 |
| JP | 57-42434 | * | 3/1982 |
| JP | 62-100328 | * | 5/1987 |

(Continued)

OTHER PUBLICATIONS

European Search Report dated Jan. 14, 2005; For Application No. EP 03 25 3173.

(Continued)

*Primary Examiner*—Patrick Mackey
*Assistant Examiner*—Thomas A Morrison
(74) *Attorney, Agent, or Firm*—Pillsbury Winthrop Shaw Pittman, LLP

(57) ABSTRACT

A sheet take-out apparatus has a stacker that houses sheets in the stacked state, a take-out roller for taking out sheets by rotating in contact with a sheet at one end in the stacking direction of housed sheets, and sensors for detecting a contact pressure of the take-out roller to sheets. A controller monitors a contact pressure of the take-out roller to sheets, energizes a motor so as to adjust a contact pressure to a proper value and moves the take-out roller in the stacking direction.

5 Claims, 14 Drawing Sheets

FOREIGN PATENT DOCUMENTS

| | | | |
|---|---|---|---|
| JP | 2-18229 | * | 1/1990 |
| JP | 2-95626 | * | 4/1990 |
| JP | 2-127327 | * | 5/1990 |
| JP | 4-354736 | * | 12/1992 |
| JP | 05-032338 | | 2/1993 |
| JP | 06-048594 | | 2/1994 |
| JP | 6-92483 | * | 4/1994 |
| JP | 07-041191 | | 2/1995 |
| JP | 07-237759 | | 9/1995 |
| JP | 09286530 A | | 4/1997 |
| JP | 09-194067 | | 7/1997 |
| JP | 2000-198562 | | 7/2000 |

OTHER PUBLICATIONS

Notification of Reasons for Refusal of Japanese Patent Application No. 2002-154428, dated May 22, 2007.

* cited by examiner

TAKE-OUT APPARATUS

This application claims priority to Japanese Patent Application No. 2002-154428, filed May 28, 2002.

BACKGROUND OF THE INVENTION

1. Field of the Invention

The present invention relates to a take-out apparatus to take out a sheet one by one separated from sheets in the stacked state.

2. Description of the Related Art

So far, for example, a postal matter take-out apparatus (hereinafter, simply referred to as a take-out apparatus) to take out one by one from postal matters in the stacked state and feed to a processing portion at the latter stage is known as a take-out apparatus.

This take-out apparatus has a stacker to house plural postal matters in the stacked state in the erected position. There is a take-out roller provided to pressure push postal matters out of plural postal matters stacked in the stacker at one end in the stacked direction. This apparatus has a separation portion to receive the postal matters taken out by the take-out roller and pass through a nip portion formed between a feed roller and separate postal matters taken out in the overlapped state. Further, the apparatus has a pull out portion to receive the front end of a postal matter passing through the nip portion of the separation portion and pulling it out and feed to the processing portion at the latter stage.

The take-out roller rotates in a prescribed direction and takes out postal matters at one end in the stacked direction on a conveying path. The take-out roller is arranged to press fit to postal matters at one end in the stacking direction using a spring/a counter balance.

The separation portion has a feed roller to feed postal matters taken out by the take-out roller on the conveying path along it and a separation roller in contact with the feed roller on the conveying path. The separation roller generates a torque in the direction reverse to the conveying direction and separates a second and subsequent postal matters from postal matters at one end of the stacking direction.

The pull out portion has a pull out roller pair that rotates at a peripheral velocity faster than at least the feed roller of the separation portion, and pulls out a postal matter clamped in the nip portion between the feed roller and the separation roller of the separation portion. Thus, the velocity of the feed roller of the separation portion and that of the pull out roller are differentiated, a gap between postal matters being conveyed on the conveying path is kept at a constant level.

However, in a conventional take-out apparatus described above, the take-out roller is pressed against postal matters at one end in the stacking direction using a spring or a counterbalance and therefore, a contact pressure of the take-out roller to postal matters at one end in the stack direction changes depending on difference in volume, elasticity, weight, etc. of postal matters stacked at one end of the stacking direction and the contact pressure could not be stabilized. Therefore, in the case of conventional apparatus, all of stacked postal matters could not take out under the same conditions and various problems were taken place. That is, there were such problems that if the contact pressure of the take-out roller was lower than a proper value, postal matters could not taken out and if the contact pressure was higher than a proper value, two sheets were taken out at a time in many cases.

Further, in the case of the above-mentioned conventional taken out apparatus, postal matters thicker or thinner than a defined thickness were processed jointly with postal matters in defined thickness and such postal matters in different materials as paper, vinyl sheets, etc. Therefore, the separation torque in the separation portion was set at a relatively large torque. That is, in order to separate all postal matters in different state one by one in the separation portion, it was necessary to increase the separation efficiency by setting a torque in the reverse direction by the separation roller relatively large. However, when the torque of the separation roller is increased, there was such a problem that postal matters were contaminated or damaged by a friction between the surfaces of postal matters and the separation roller when postal matters are pulled out by the pull out pair.

Furthermore, in the case of the above-mentioned conventional take-out apparatus, plural postal matters are taken out by the take out roller and the velocity of the feed roller of the separation portion and the pull out roller is made difference so as to form a certain gap between postal matters. However, there were many cases wherein a gap could not stabilize by jamming or slip of postal matters.

SUMMARY OF THE INVENTION

An object of the present invention is to provide a take-out apparatus capable of taking out sheets in the stacked state surely and stably, feeding out by separating the taken sheets one by one certainly and keeping a conveying interval of sheets at a constant level.

According to the present invention, a take-out apparatus is provided. This apparatus comprises: a supply mechanism to supply plural sheets in the stacked state by moving them in the stacking direction from one end of the stacking direction sequentially to a prescribed take-out position; a take-out roller to take out the sheets in contact with them and rotating them supplied to the take-out position; and a pressing mechanism to press the take-out roller always at a fixed pressure against the sheets at the take-out position.

DETAILED DESCRIPTION OF THE EMBODIMENT

Embodiments of the present invention will be explained below in detail referring to the attached drawings.

Figure 2:
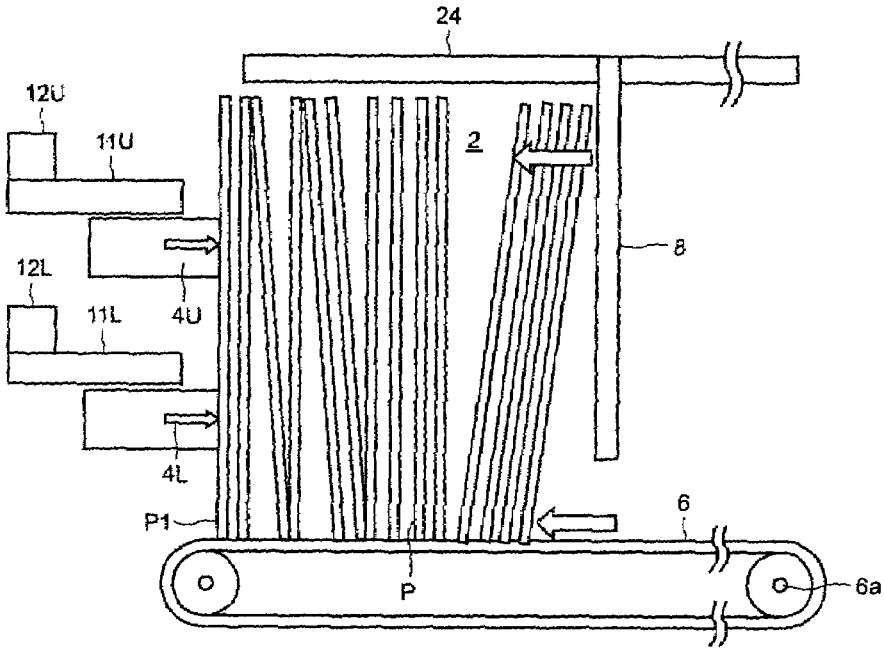
FIG. 2 is a front view of a take-out apparatus showing along Section II-II' in FIG. 1.
Figure 3:
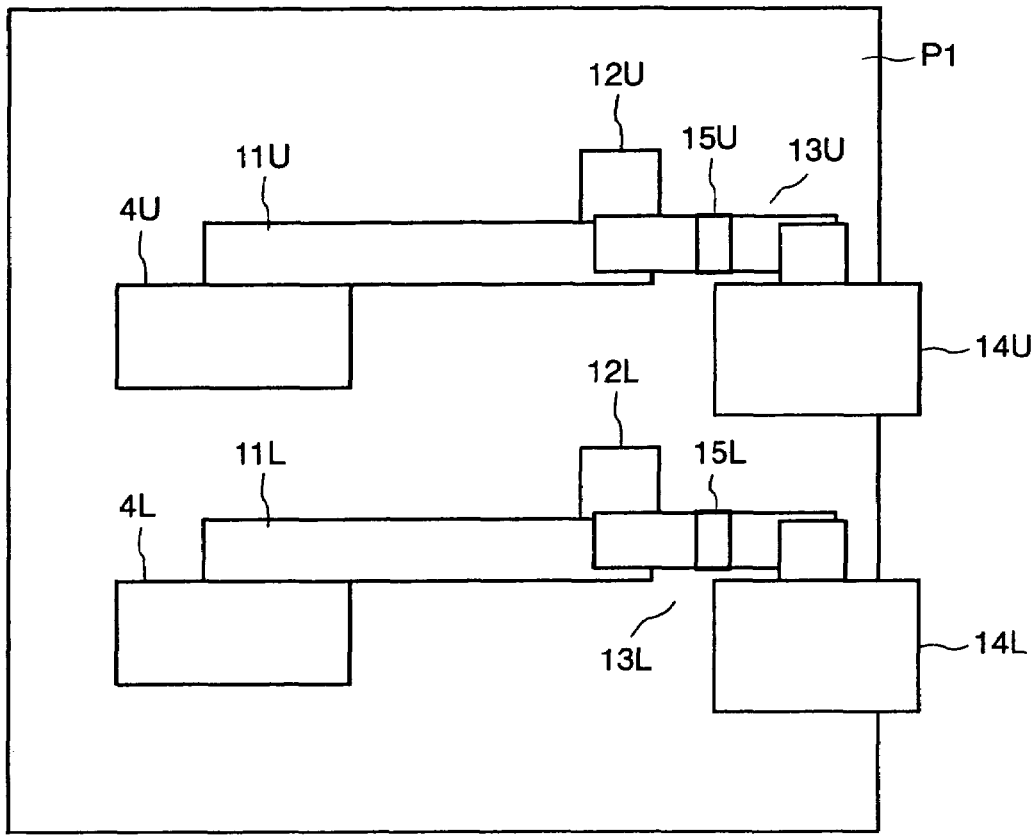
FIG. 3 is a side view of the take-out apparatus shown along III-III in FIG. 2.

FIG. 1 is a plan view of the sheet take-out apparatus 1 (hereinafter, simply called a take-out apparatus 1) in a first embodiment of the present invention viewed from the above. FIG. 2 is a front view of the take-out apparatus 1 and FIG. 3 is a side view of the take-out apparatus 1.

As shown in FIG. 1, the take-out apparatus 1 comprises a stacker 2, a take-out roller 4, a floor belt 6, a backup plate 8, and a separation portion 10.

In the stacker 2, such sheets P as, for example, postal matters are stacked in the erected state in the state of plural sheets stacked in the plane direction.

The take-out roller 4 takes out a sheet P1 (a first sheet) nearly in the horizontal direction (the arrow direction T in the figure) by rotating in contact with the sheet P1 at one end in the stacking direction (the extreme left in the figure).

The floor belt 6 is extended to run along the stacking direction of sheets P in contact with the lower sides of all sheets stacked in the stacker.

The backup plate 8 is provided movably in the stacking direction in contact with the plane of a sheet P2 (a second sheet) near the upper end away from the floor belt 6 (the extreme right in the figure).

The separation portion 10 separates sheets P taken out by the take-out roller 4 one by one and feeds to the processing portion at the latter stage.

As shown in FIG. 2, the take-out roller 4 has a lower roller 4L in contact with the lower end of the sheet P1 at one end in the stacking position and an upper roller 4U in contact with the upper end of the sheet P1. The lower roller 4L and the upper roller 4U are provided rotatably along a prescribed direction centering on a rotary shaft 5 (see FIG. 1A) extending nearly in the vertical direction; that is, the direction to take out the sheet P1.

The rotary shafts 5 of the rollers 4L and 4U are mounted rotatably to the ends of arms 11L and 11U, respectively. The base portions of the arms 11L and 11U are mounted rotatably to the housing (not shown) of the take-out apparatus 1. The rollers 4L and 4U are brought in contact with or separated from the sheet P1 at one end of the stacking direction by oscillating the arms 11L and 11U by motors 14L and 14U that will be described later.

At the base portions of the arms 11L and 11U, there are sensors 12L and 12U (detecting portions) provided for detecting the positions of the rollers 4L and 4U to contact the sheet P1; that is, the positions XL and XU along the stacking direction to contact the sheet P1.

Further, to the base portions of the arms 11L and 11U, motors 14L and 14U for oscillating the arms 11L and 11U are connected via link mechanisms 13L and 13U (FIG. 3). The arms 11L and 11U having the rollers 4L and 4U mounted rotatably, the link mechanisms 13L and 13U, and the motors 14L and 14U function as moving mechanisms to move the rollers 4L and 4U in the stacking direction of a sheet P.

As shown in FIG. 3, sensors 15L and 15U (detecting portions) are mounted at the middle portion of the link mechanisms 13L and 13U for detecting contact pressures FL and FU of the corresponding rollers 4L and 4U to contact the sheet P1. The sensor 15L (a first sensor) detects a contact pressure FL (a first contact pressure) of the lower roller 4L to contact the sheet P1. The other sensor 15U (a second detector) detects a contact pressure FL (a second contact pressure) of the upper roller 4U to contact the sheet P1. That is, by monitoring outputs of the sensors 15L and 15U and driving the motors 14L and 14U, it is possible to bring the rollers 4L and 4U to contact to the sheet P1 at a desired contact pressure.

At the base portions of the arms 11L and 11U, two pulleys 16 and 17 are mounted rotatably in one body to the rotary shaft of the arm 11. An endless belt 18 wound round the pulley 4 mounted to the rotary shaft 5 of the rollers 4L and 4U is wound round one of the pulley 4*a*. An endless belt 20 wound round a pulley 19*a* mounted to the rotary shaft of a motor for simultaneously rotating the rollers 4L and 4U is wound round the other pulley 17. When the motor 19 is rotated, the lower roller 4L and the upper roller 4U are rotated in a prescribed direction at a desired velocity.

Further, the lower roller and the upper roller 4L and 4U are moved by a seesaw mechanism (not shown) in the directions opposite to each other. For example, when the lower roller 4L is pushed by the sheet P1 and moved in the left direction in FIG. 1, the upper roller 4U is moved in the right direction in FIG. 1. On the contrary, when the upper roller 4U is pushed by the sheet P1 and moved in the left direction in FIG. 1, the lower roller 4L is moved in the right direction in FIG. 1.

The floor belt 6 has two endless belts extended along the stacking direction of a sheet P at the front side and the rear side of the apparatus. A motor 22 (a first moving mechanism) is connected to the rotary shaft 6*a* of one of the rollers with belts wound round (not shown) for running the floor belt 6 along the stacking direction in both the forward and reverse directions.

The backup plate 8 is mounted to a rail 24 extended in the stacking direction to freely slide near the upper end separated from the floor belt 6 at the rear side of the stacker 2. The backup plate 8 is provided at a position to contact the surface of the sheet P2 stacked in the erected state in the stacker 2 mainly at the upper end of the other end in the stacking direction. Further, the backup plate 8 is moved in the stacking direction along the rail 24 by a motor 26 (a second moving mechanism) connected via a drive transmission mechanism (not shown).

The floor belt 6 driven by the motor 22 and the backup plate 8 driven by the motor 26 function as a supply mechanism of the present invention to supply the sheet P1 at one end in the stacking direction to a prescribed take-out position by moving plural sheets stacked in the stacker 2 in the stacking direction by incorporating each other. In this take-out apparatus 1, as a sheet is taken out by the take-out roller 4 sequentially from the sheet P1 at one end in the stack direction on the conveying path, when the floor belt 6 is run every time when a sheet P is taken out, the backup plate 8 is moved. In other words, the floor belt 6 and the backup plate 8 are driven so that the sheet P1 at one end in the stack position is always supplied to a prescribed take-out position.

The separation portion 10 is provided with a feed roller 32 at the position to contact one of the planes (the left side plane in FIG. 1) of the sheet P taken out in the arrow direction T by the take-out roller 4 and a separation roller 34 arranged at the opposite position to the feed roller 32 with a prescribed gap via the sheet P conveying path. The separation portion 10 is provided with a motor 36 for rotating the feed roller 32 in the feeding direction (the forward direction) of the sheet P and a motor 38 for giving a tangential force by giving a rotating tangential force in the reverse direction to the separation roller 34.

An endless belt 33 is extended and wound round a pulley 36*a* attached to the rotary shaft of the motor 36 and a pulley 32*a* attached to the rotary shaft of the feed roller 32. Further, an endless belt 35 is extended and wound round a pulley 38*a* attached to the rotary shaft of a motor 38 and a pulley 34*a* attached to the separation roller 34. A tangential force is generated by rotating the feed roller 32 in the forward direction and being given a tangential force in the reverse direction to the separation roller 34 by the motor 38.

Further, the take-out apparatus 1 is provided with a controller 40 for controlling the drive of the motors 14L, 14U, 19, 22, 26, 36 and 38 by monitoring the outputs of the sensors 12L, 12U, 15L and 15U. The controller 40 regulates contact pressures FL and FU of the lower roller 4L and the upper roller 4U to proper values mainly based on the results of detection by the sensors 15L and 15U. Further, the controller 40 regulates the contact pressures FL and UL of the lower roller 4L and/or the upper roller 4U to proper values by moving the floor belt 6 and/or the backup plate 8 by controlling the motors 22 and 26.

Figure 4:
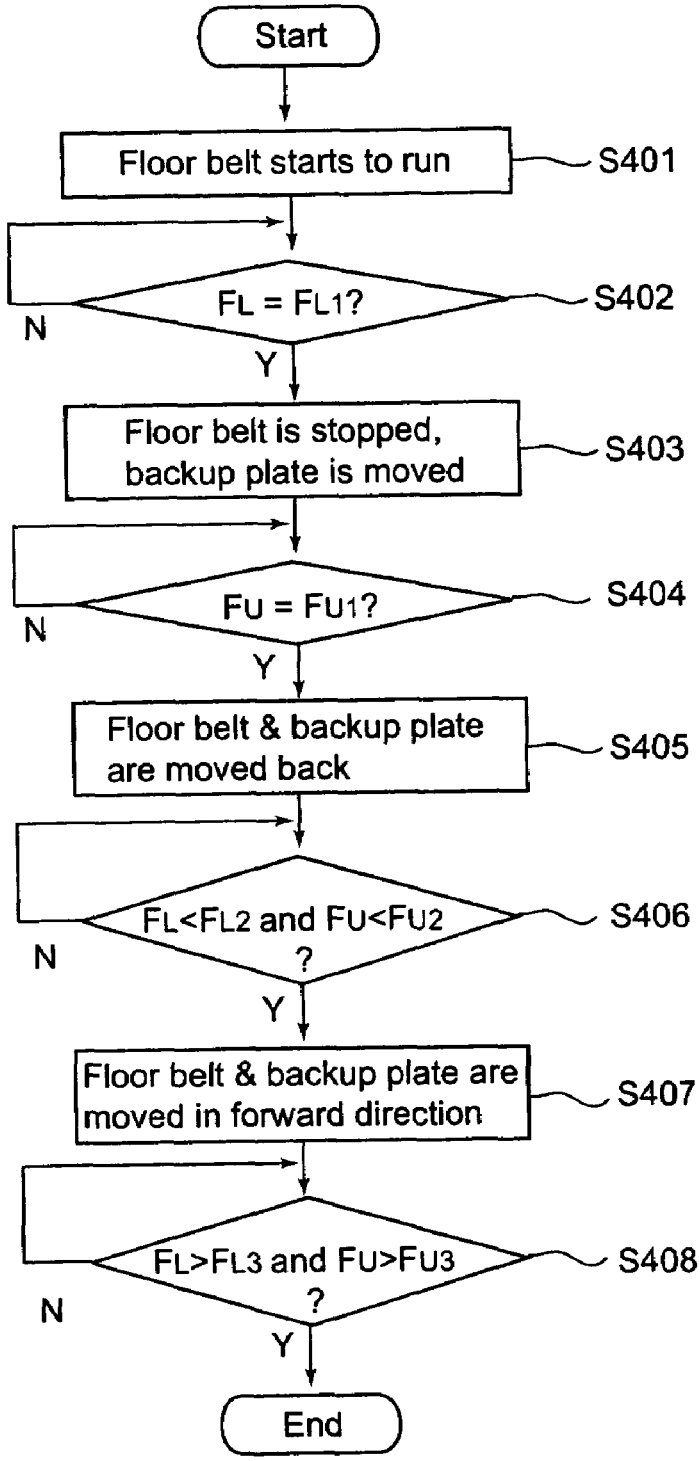
FIG. 4 is a flowchart for explaining the initializing operation of the take-out apparatus shown in FIG. 1.

Next, the initializing operation of the above-mentioned take-out apparatus will be explained referring to a flowchart shown in FIG. 4.

Prior to the initializing operation, the lower roller 4L and the upper roller 4U are moved to the home positions and plural sheets P that are processing objects are set in the stacker 2. Sheets P are set between the take-out roller 4 and the backup plate 8 and are stacked in the plane direction and in the erected state in the stacker 2 with the lower sides brought in contact with the floor belt 6.

When the power source of the take-out apparatus is turned on and the initializing operation starts, the motor 22 is first driven and the floor belt 6 starts to run in the forward direction, that is, in the direction toward the take-out roller 4 (Step 401). Then, the lower sides of all sheets P stacked in the stacker 2 are moved toward the take-out roller 4 and mainly, the lower sides of the sheets P are biased in the stacking direction of the take-out roller 4.

At this time, the contact pressure FL of the sheet P1 at one end in the stacking direction, that is, at the end of the moving direction to contact the lower roller 4L is monitored by the controller 40 via the sensor 15L and the floor belt 6 runs continuously until this contact pressure FL reaches a pre-set criteria of judgment FL1 (Step 402).

Then, when the contact pressure FL of the lower roller 4L reaches the criteria of judgment FL1 (Step 402; YES), the motor 22 is stopped, the floor belt 6 is stopped, the motor 26 is driven and the backup plate 8 is moved along the stacking direction of sheets P toward the take-out roller 4 (Step 403). Thus, the backup plate presses the mainly upper end sides of the sheets P stacked in the stacker 28 and biases toward the take-out roller 4.

At this time, the contact pressure of the sheet P1 at one end in the stacking direction to contact the upper roller 4U is monitored by the controller 40 via the sensor 15U, and the backup plate 8 is moved until this contact pressure FU reaches a pre-set criterion of judgment FU1 (Step 404). Then, when the contact pressure FU of the upper roller 4U reaches the criteria of judgment FU1 (Step 404; YES), the motor 26 is stopped and the backup plate 8 is stopped.

Hereafter, the contact pressure for a sheet 1 is slightly higher and is reduced to a prescribed pressure. Because of this, two motors 22 and 26 are slightly counter rotated and the floor belt 6 is returned slightly in the reverse direction, and the backup plate 8 is slightly moved hack in the reverse direction (Step 405). Then, when the contact pressure FL of the lower roller 4L is decreased to below the pre-set criteria of judgment FL2 and the contact pressure FU of the upper roller 4U is decreased to below the pre-set criteria of judgment FU2 (Step 406; YES), two motors 22 and 26 are stopped, the floor belt 6 is stopped and the backup plate 8 is stopped.

Further, hereafter, two motors 22 and 26 are again rotated in the forward direction, the floor belt 6 is run in the forward direction, and the backup plate 8 is also moved in the forward direction (Step 40'). Then, when the contact pressure FL of the lower roller 4L exceeds a pre-set criterion of judgment FL3 and the contact pressure FU of the upper roller 4U exceeds a pre-set criteria of judgment FU3 (Step 408; YES), two motors 22 and 26 are stopped, the floor belt 6 is also stopped, and the backup plate 8 is stopped.

By a series of initializing operations described above, the contact pressure FL of the lower roller 4L and the contact pressure FU of the upper roller 4U to the sheet P1 at one end in the stacking direction are regulated to proper values (FL3 and FU3 in this case).

Hereafter, however, when the take-out operation of sheets P stacked in the stacker 2 starts, the contact pressures FL and FU of the lower and upper rollers 4L and 4U change as a result of decrease in stacked volume of sheets P. Therefore, as described below, the take-out apparatus is operated and he contact pressures FL and FU are regulated to proper values during the sheet take-out operation in this embodiment.

Figure 5:
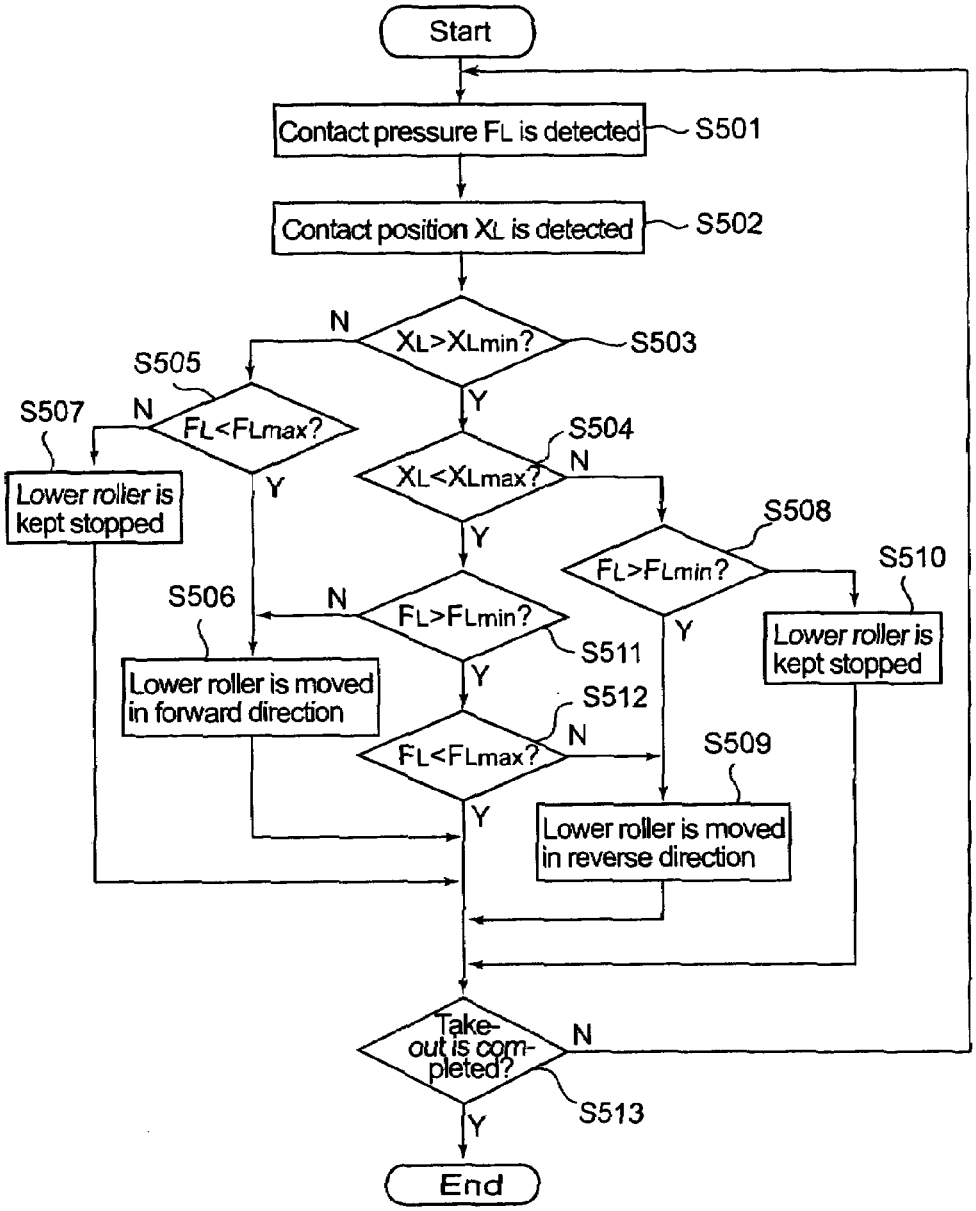
FIG. 5 is a flowchart for explaining the control operation of a motor for regulating the contact pressure of a lower roller of the take-out apparatus shown in FIG. 1 to a proper value.

The control operation of the motor 14L for regulating the contact pressure FL of the lower roller 4L to a proper value will be explained below referring to a flowchart shown in FIG. 5. That is, the operation to regulate the contact pressure FL of the lower roller 4L to a proper value by moving the lower roller 4L according to the stacked volume of sheets P will be explained here. Further, although the explanation for the upper roller 4U is omitted here, the contact pressure FU of the upper roller 4U is also regulated to a proper value by controlling the motor 14U likewise the lower roller 4L.

During the take-out operation of the sheet P, the contact pressure FL of the lower roller 4L to the sheet P1 at one end in the stacking direction is detected through the sensor 15L (Step 501) and the contact position XL of the lower roller 4L to the sheet P1 is detected through the sensor 12L (Step 502). The contact pressure FL and the contact position XL of the lower roller 4L change according to the state of sheets P (for example, a stacked volume) stacked in the stacker 2.

Figure 1A:
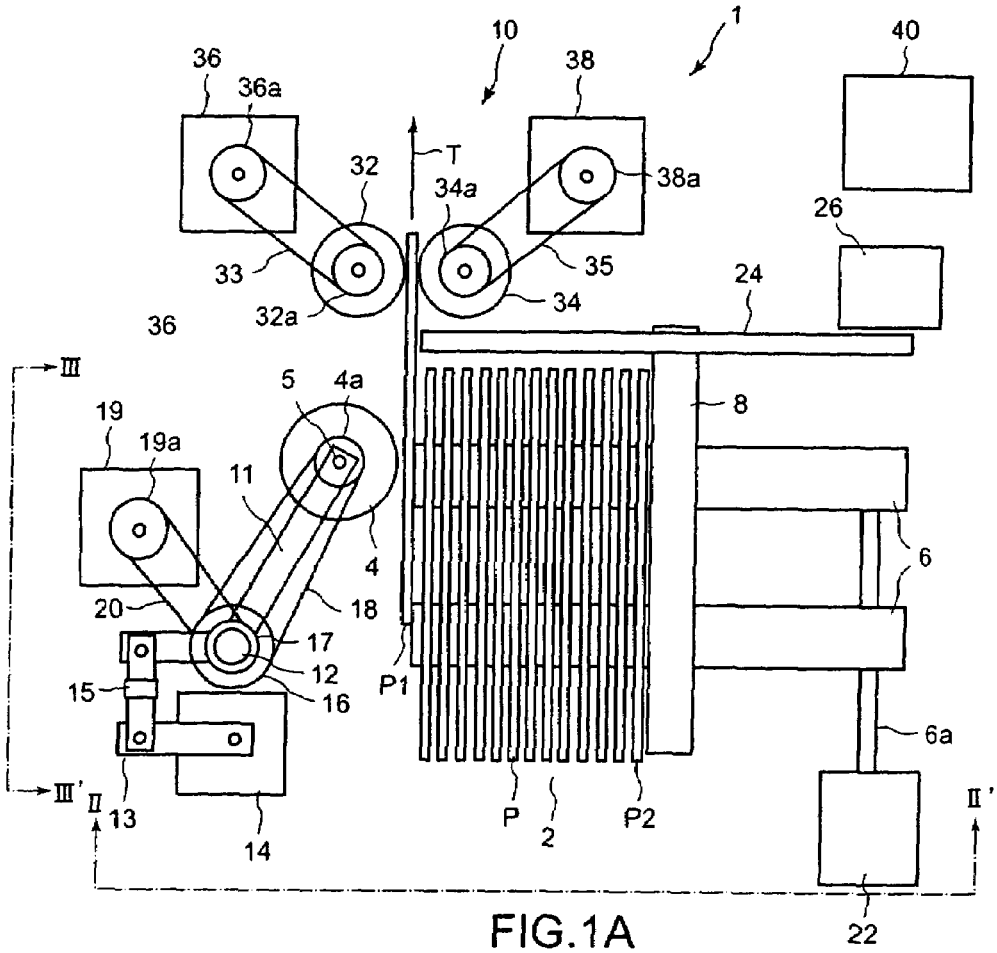
FIG. 1A is a plan view showing a first embodiment to the take-out apparatus of the present invention.
Figure 1B:
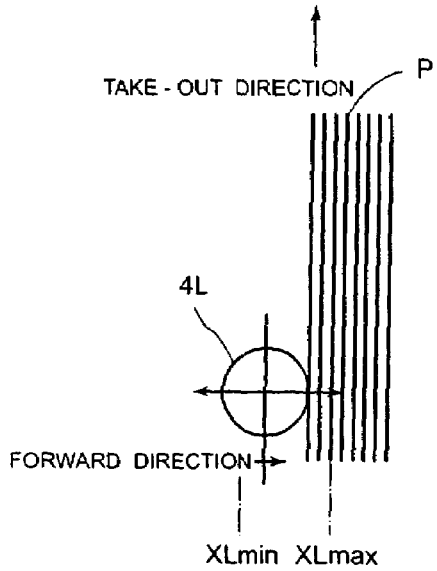
FIG. 1B is a schematic diagram for explaining the position of the take-out roller to contact sheets.

Then, the contact position XL of the lower roller 4L detected in Step 502 is compared with a pre-set tolerance (XLmin–XLmax) and it is judged whether the lower roller 4L exceeds XLmin and is positioned in the left direction as shown in FIG. 1A and FIG. 1B (Step 503) or exceeds XLmax and is positioned in the right direction by exceeding XLmax as shown in FIG. 1 (Step 504). At this time, XLmin and XLmax indicate the left side limit value and the right side limit value of the contact position where sheets P can be taken out normally and are set at such values that the sheet P1 taken out by the lower roller 4L positioned in the tolerance is satisfactorily introduced between the feed roller 32 and the separation roller 34 of the separation portion 10.

When the contact position XL of the lower roller 4L is judged to have shifted to the left side by exceeding XLmin (Step 503; NO), the contact pressure FL of the lower roller 4L detected in Step 501 is judged whether it is above the pre-set upper limit value FLmax (Step 505). That is, a tolerance for the normal take-out of sheets P is also pre-set for the contact pressure FL of the lower roller 4L, and the upper limit value of the tolerance is assumed here at FLmax and the lower limit value at FLmin.

In Step 505, when the contact pressure FL of the lower roller 4L is judged to be not exceeding the upper limit value FLmax (Step 505; YES), the motor 14L is driven so as to bring the contact position XL of the lower roller 4L close to the tolerance and the lower roller 4L is moved in the direction to push in the sheet P1 (Step 506). On the other hand, when it is judged in Step 505 that the contact pressure FL of the lower roller 4L is above the upper limit value FLmax (Step 505; NO), the contact position XL of he lower roller 4L can be no longer brought to close the tolerance and therefore, the motor 14L is not driven and the lower roller 4L is kept stopped in the as-is state (Step 507).

On the other hand, when it is judged in Step 504 that the contact position XL of the lower roller 4L exceeds the XLmax and is shifted to the right side in FIG. 1 (Step 504; NO), the contact pressure FL of the lower roller 4L detected in Step 501 is judged whether it is higher than the lower limit value FLmin of the above-mentioned tolerance (Step 508).

When the contact pressure FL of the lower roller 4L is judged higher than the lower limit value FLmin in Step 508 (Step 508; YES), the motor 14L is counter rotated in the direction so as to bring the contact position XL of the lower roller 4L close to the tolerance and the lower roller 4L is moved in the direction to leave the sheet P1 (the left direction in the figure) (Step 509). On the other hand, in Step 508 when the contact pressure FL of the lower 4L is judged below the lower limit value FLmin (Step 508; NO), the lower roller 4L is kept stopped at the current position because the contact position XL of the lower roller 4L can no longer be brought close to the tolerance (Step 10).

On the contrary, when it is judged in Steps 503 and 504 that the contact position XL of the lower roller 4L is within the tolerance (XLmin–XLmax) (Step 503; YES and Step 504; YES), the contact pressure FL of the lower roller 4L detected in Step 1 is compared with the above-mentioned tolerance (FLmin to FLmax) and the contact pressure is judged whether it is higher than the lower limit value FLmin (Step 511) and also, whether it is lower than the upper limit value FLmax (Step 512).

Further, when the contact pressure FL of the lower roller 4L is judged to be below the lower limit value FLmin in Step 511 (Step 511; NO), the operation is shifted to the above-mentioned processing in Step 6, the motor 14L is driven, the lower roller 4L is moved in the direction to press the sheet P1, and the contact pressure FL of the lower roller 4L is increased.

Further, in Step 512 when the contact pressure FL of the lower roller 4L is judged to be above the upper limit value FLmax (Step 512; MO), the operation is shifted to the above-mentioned processing in Step 509, the motor 14L is counter rotated and the lower roller 4L is moved in the direction to go away from the sheet P1, and the contact pressure FL of the lower roller 4L is weakened.

As described above, the processes in Steps 501 to 512 are carried out continuously until the sheet P take-out operation by the take-out apparatus 1 is completed (Step 513; YES) and the contact pressure FL of the lower roller 4L in the sheet P take-out operation is constantly regulated to a proper value.

Figure 6:
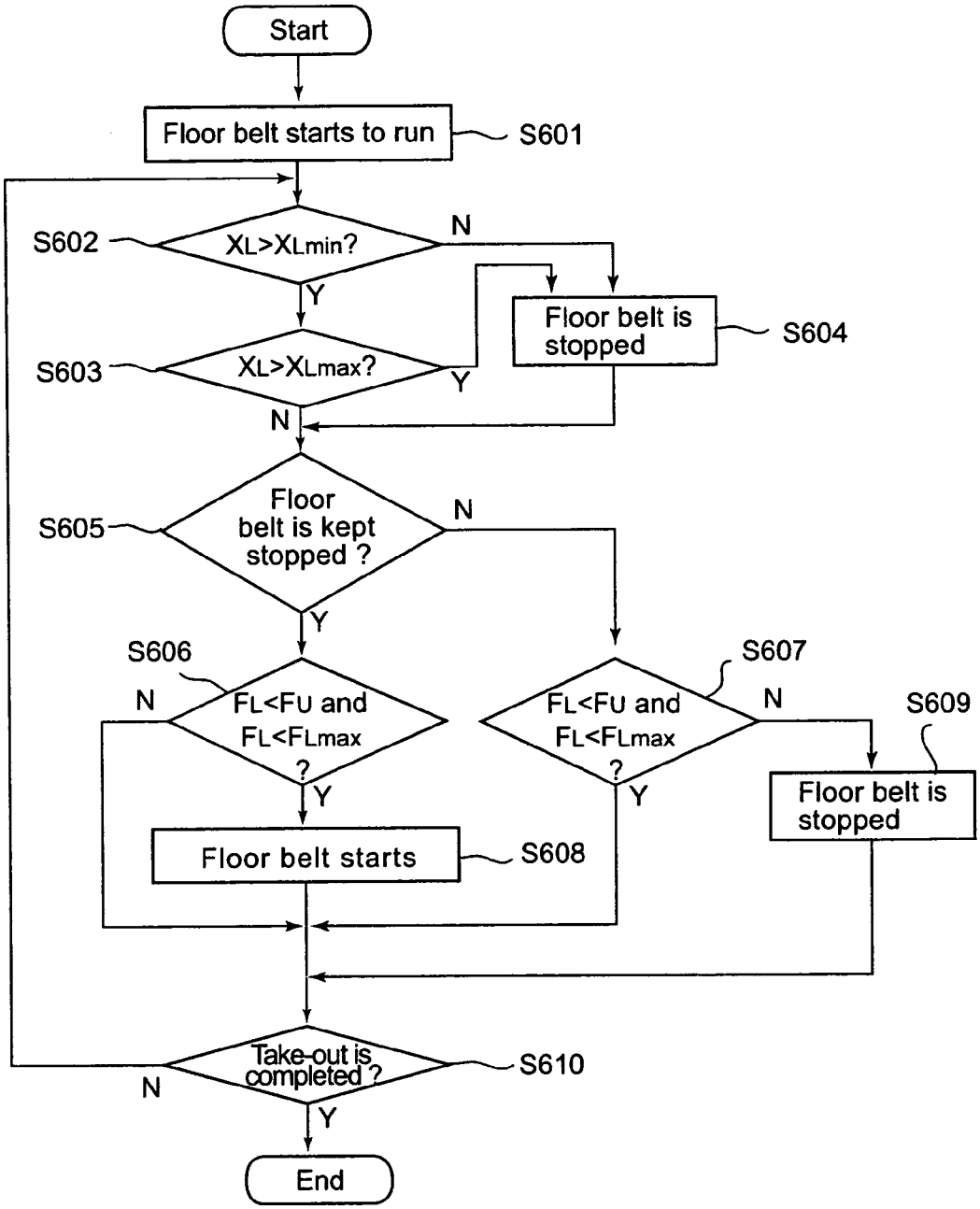
FIG. 6 is a flowchart for explaining the control operation of a floor belt of the take-out apparatus shown in FIG. 1.

Next, referring to a flowchart shown in FIG. 6, the control method of the floor belt 6 for regulating the contact pressure of the take-out roller 4 to a proper value will be explained. Further, the control operation of the floor belt 6 explained here is executed in parallel with the control operation of the lower roller 4L (and the upper roller 4U) explained in the flowchart shown in FIG. 5.

First, the motor 22 is driven and the floor belt 6 starts to run (Step 601). Then, the contract position XL of the lower roller 4L to the sheet P1 at one end in the stacking direction is detected through the sensor 12L. This contact position XL is compared with the pre-set tolerance (XLmin to XLmax) (Steps 602 and 603). At this time, the lower limit value XLmin and the upper limit value XLmax of the tolerance are set at values differing from the values that are set for controlling the operation of the lower roller 4L mentioned above.

When the contact position XL of the lower roller 4L is judged to be below the lower limit value XLmin (Step 602; NO) and the contact position XL is judged to be within the tolerance (XLmin to XLmax) (Step 603; YES), the motor is stopped and the floor belt 6 is stopped so that sheets P do not press the lower roller 4L (Step 604).

On the other hand, when the contact position XL of the lower roller 4L is judged to be above the upper limit value XLmax (Step 603; NO), it is judged whether the floor belt 6 is kept stopped (Step 605), and the contact pressure FL of the lower roller 4L is compared with the contact pressure FU of the upper roller 4U (Steps 606 and 607). That is, a tolerance is also pre-set for the contact pressure FL of the lower roller 4L and its lower limit value FLmin and the upper limit value FLmax are set at such values that sheets P can be taken out normally.

In Step 605, when the floor belt 6 is judged as kept stopped (Step 605; YES) and the contact pressure FL of the lower roller 4L is judged to be lower than the contact pressure FU of the upper roller 4U and also lower than the upper limit value FLmax in Step 606 (Step 606; YES), the motor 22 is driven and the floor belt 6 is run in the forward direction so that the lower roller 4L is pressed by sheets P (Step 608). Thus, the contact pressure FL of the lower roller 4L is increased.

Further, when it is judged in Step 605 that the floor belt 6 is not kept stopped (Step 605; NO) and in Step 607 that the contact pressure FL of the lower roller 4L is higher than the contact pressure FU of the upper roller 4U or higher than the upper limit value FLmax (Step 607; NO), the motor 22 is stopped and the floor belt 6 is also stopped (Step 609).

Thus, the processes in the above-mentioned Steps 602 to 609 are carried out continuously and the driving of the floor belt 6 is controlled until the sheet P take-out operation by the take-out apparatus 1 is completed (Step 610; YES).

Figure 7:
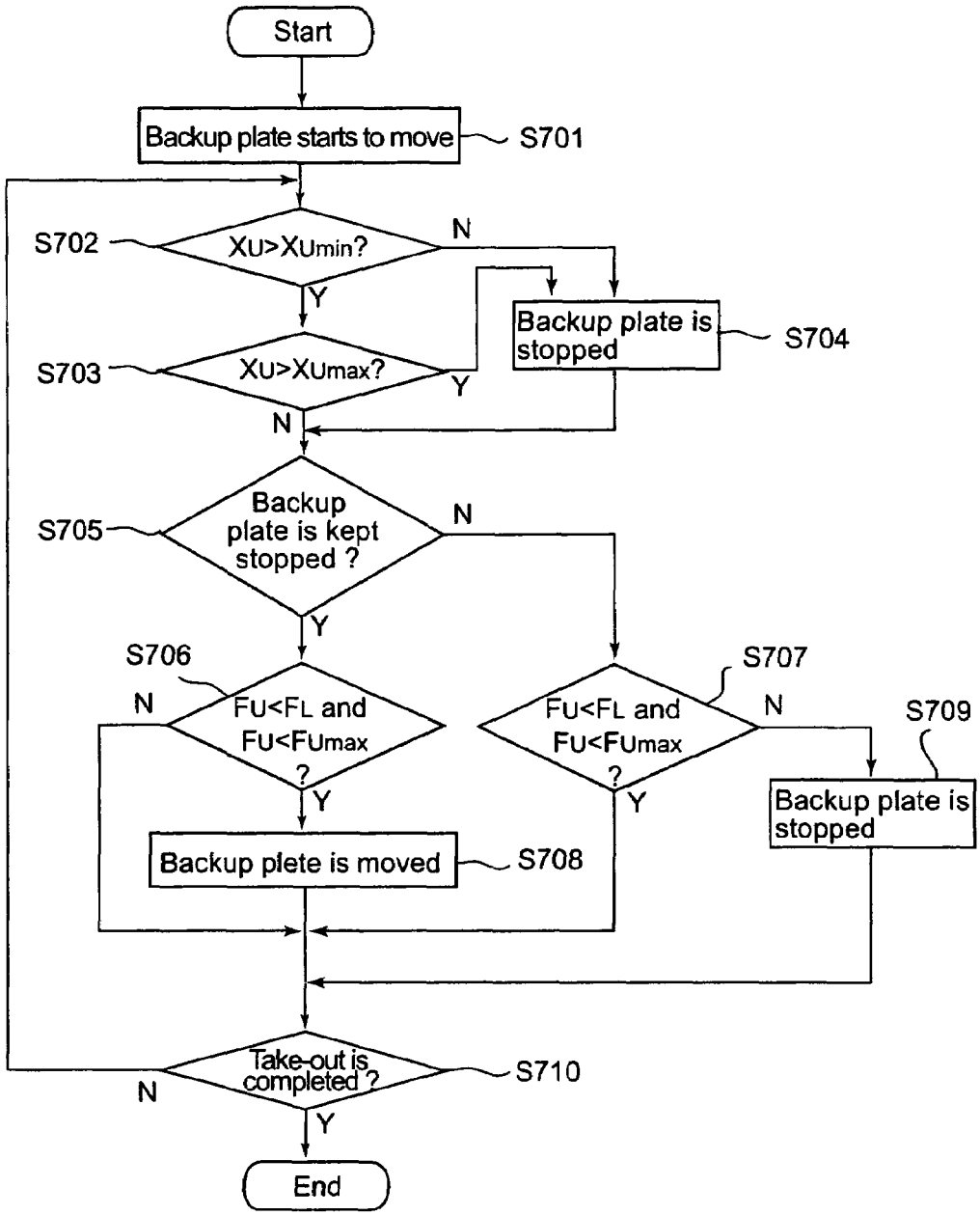
FIG. 7 is a flowchart for explaining the control operation of a backup plate of the take-out apparatus shown in FIG. 1.

Next, referring to a flowchart shown in FIG. 7, the control method of the backup plate 8 for regulating the contact pressure of the take-out roller 4 to a proper value will be explained. Further, the control operation of the backup plate 8 explained here is carried out in parallel with the control operation of the lower roller 4L (and the upper roller 4U) explained in the flowchart shown in FIG. 5 and the control operation of the floor belt 6 explained in the flowchart shown in FIG. 6.

First, the motor 26 is driven and the backup plate 8 is moved toward the take-out roller 4 (Step 701). Then, the contact position XU of the upper roller 4U to the sheet P1 at one end in the stacking direction is detected through the sensor 12U, and this contact position XU is compared with the pre-set tolerance (XUmin to XUmax) (Steps 702 and 703).

When it is judged that the contact position XU of the upper roller 4U is below the lower limit value XUmin (Step 702; NO) and that the contact position XU is within the tolerance (XUmin to XUmax) (Step 703; YES), the motor 26 is stopped and the backup plate 8 is stopped so that the upper roller 4U is not pressed by sheets P (Step 704).

On the other hand, when it is judged that the contact position XU of the upper roller 4U is above the upper limit value XUmax (Step 703; NO), it is also judged whether the backup plate 8 is kept stopped (Step 705), and the contact pressure FU of the upper roller 4U is compared with the contact pressure FL of the lower roller 4L and with its upper limit value FUmax (Steps 706 and 707). That is, a tolerance is also pre-set for the contact pressure FU of the upper roller 4U and its lower limit value FUmin and FUmax are set at such values that sheets P can be taken out normally.

When it is judged in Step 705 that the backup plate 8 is kept stopped (Step 705; YES) and the contact pressure FU of the upper roller 4U is lower than the contact pressure FL of the lower roller 4L and the upper limit value FUmax in Step 706 (Step 706; YES), the motor 26 is driven and the backup plate 8 is run in the forward direction where the upper roller 4U is pressed by sheets P (Step 708). As a result, the contact pressure FU of the upper roller 4U is increased.

Further, when it is judged that the backup plate 8 is not kept stopped in Step 705 (Step 705; NO) and the contact pressure FU of the upper roller 4U is higher than the contact pressure FL of the lower roller 4L or higher than the upper limit value FUmax in Step 707 (Step 707; NO), the motor 26 is stopped and the backup plate 8 is stopped (Step 709).

The above-mentioned processes in Step 702 to 709 are carried out continuously until the sheet P take-out operation by the take-out apparatus 1 is completed (Step 710; YES) and the driving of the backup plate 8 is controlled.

As described above, according to this embodiment, the contact pressure of the take-out roller 4 is detected through the sensor 15, and the take-out roller 4, the floor belt 6 and/or the backup plate 8 are moved in the stacking direction based on this detection result, and the contact pressure of the take-out roller is regulated to a proper value. Therefore, according to the take-out apparatus 1 in this embodiment, the contact pressure of the take-out roller 4 can be prevented from changing for difference in stacking volume, elasticity, weight, etc. of sheets P and it becomes possible to press the take-out roller 4 against the sheet P1 always at a constant pressure. Thus, it is possible to solve such problems as defective take-out of sheets for insufficient contact pressure, take-out of two sheets at a time for too large contact pressure.

Figure 8:
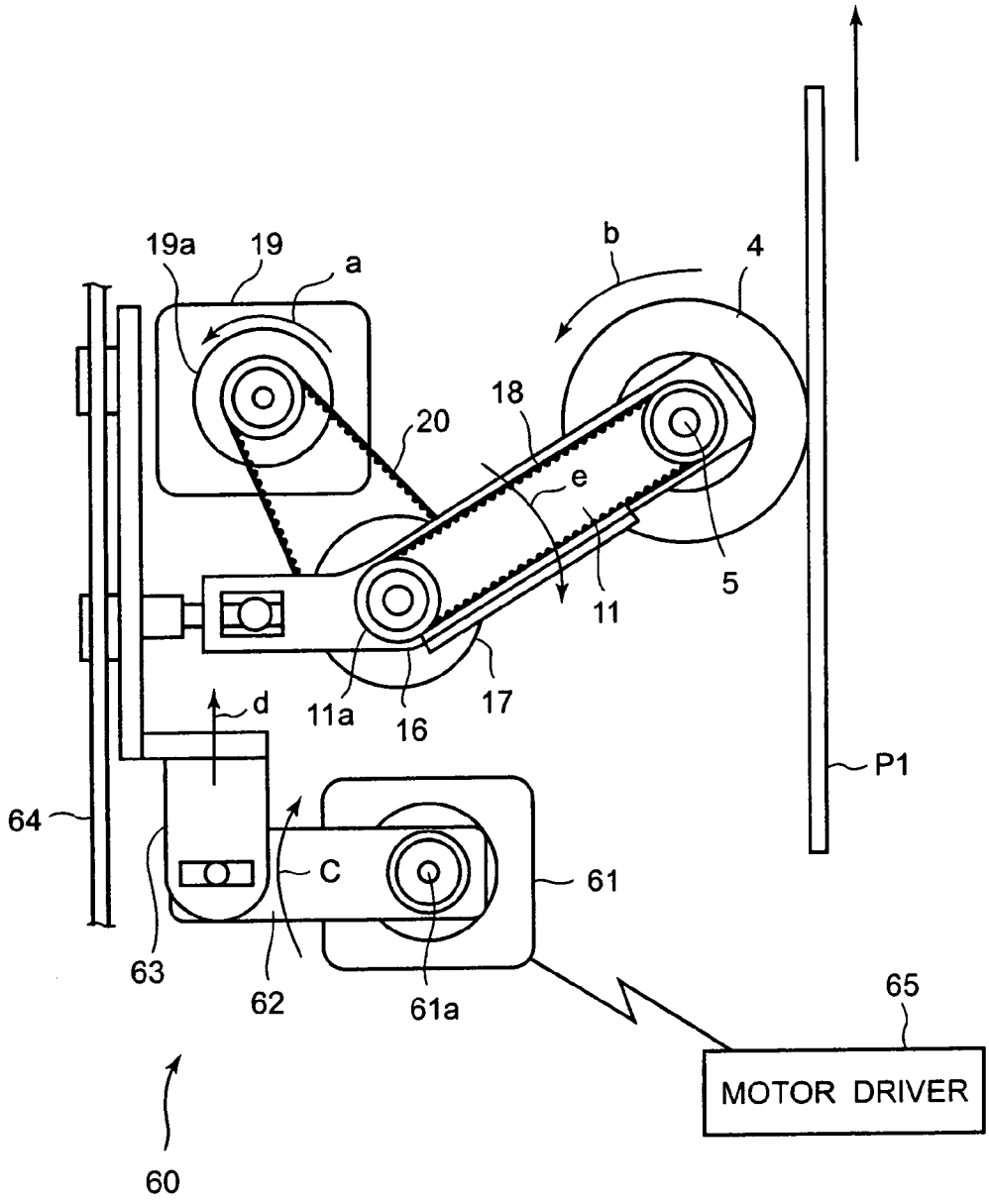
FIG. 8 is a plan view showing a second embodiment of the take-out apparatus of the present invention.

Next, the take-out apparatus in a second embodiment of the present invention will be explained referring to FIG. 8. FIG. 8 shows the construction of essential component elements only of the take-out apparatus in this embodiment. This take-out apparatus in the second embodiment is almost in the same construction as the take-out apparatus 1 in the first embodiment described above and therefore, the component elements that function similarly to the take-out apparatus 1 in the first embodiment will be assigned with the same reference numerals and the detailed explanation thereof or illustrations are omitted and only those portions differing from the first embodiment will be explained here in detail.

This take-out apparatus has the arm 11 (the supporting member) with the take-out roller 4 mounted rotatably at the end. The rotary shaft 11*a* of the arm 11 is attached stationary to the housing (not shown) of the take-out apparatus. The rotary shaft 11*a* has two pulleys 16 and 17. When the motor 19 is rotated, the take-out roller 4 is rotated irrespective of the rotating position of the arm 11. For example, when the motor 19 is rotated in the arrow direction a in FIG. 8, the take-out roller 4 is rotated in the arrow direction b in FIG. 8.

At the base portion of the arm 11 separated from the take-out roller 4, a pressing mechanism 60 is connected to press the take-out roller 4 against the sheet P1 at a fixed pressure by oscillating the arm 11 centering on the rotary shaft 11*a*.

The pressing mechanism 60 has a torque control servo motor 61 to give a fixed tangential force by outting a fixed torque, a motor arm 62 attached to a rotary shaft 61*a* of the servo motor 61, a slider 63 attached to the end of the motor arm 62, a rail 64 with the slider 63 attached slidably, and a motor driver 65 to energize the servo motor 61 to give a fixed tangential force to the arm 11. Then, the base portion of the arm 11 of the take-out roller 4 is connected to the slider 63.

When the power source is turned on and the servomotor 61 generates a prescribed tangential force according to the control of the motor driver 65, the motor arm 62 is oscillated at a prescribed tangential force and slid along the rail 64, and the arm 11 having the take-out roller 4 is oscillated. For example, when a prescribed tangential force is output through the servo motor 61, the motor arm 62 is oscillated in the arrow direction c in the figure, the slider 63 is slid in the arrow direction d in the figure, and the arm is oscillated in the arrow direction e in the figure. As a result, the take-out roller 4 is pressed against the sheet P1 at a fixed pressure.

In this embodiment, as the servomotor 61 to output a fixed tangential force is adopted, the take-out roller is always pressed against the sheet P1 at one end in the stacking direction always at a fixed pressure. In other words, irrespective of the oscillation position of the arm 11, the take-out roller 4 is pressed against the sheet P1 always at a fixed pressure. So, as in the first embodiment described above, it becomes not necessary to monitor the contact pressure of the take-out roller 4 and also it becomes not necessary to oscillate the arm 11, run the floor belt 6 or move the backup plate 8 based on the detected contact pressure. Thus, it is enabled to bring the take-out roller 4 to contact the sheet P1 always at a desired contact pressure. In other word, the take-out apparatus in this embodiment does not require a sensor for detecting the contact pressure of the take-out roller 4 and also, does not require complicated control operations as the contact pressure of the take-out roller is regulated to a proper value.

Further, in this embodiment, an oscillation angle of the arm 11 is detected and the contact position of the take-out roller 4 to the sheet P1 is detected by monitoring the output from an encoder (not shown) that is attached to the servo motor 61. As another method to detect the oscillation angle of the arm 11, a method using a photo-sensor, etc. may be used. And, according to the contact positions XL and XU of the take-out roller 4 to the sheet P1, the floor belt 6 is run and the backup plate 8 is moved so that the sheet P1 at one end in the stacking direction is supplied always in the straightforward state to the take-out position.

For example, when the contact position XL of the lower roller 4L of the take-out roller comes out of a pre-set tolerance XLmin to XLmax and shifts to the right side in the figure and the sheet P1 at one end in the stacking direction is tilted to the left side in the figure, the floor belt 6 is run toward the lower roller 4L and corrects the tilt of sheets P and at the same time, the lower roller 4L is pressed by the sheet P1 and the contact position of the lower roller 4L to the sheet P1 falls in the tolerance.

Further, for example, if the contact position XU of the upper roller 4U comes out of the pre-set tolerance XUmin to XUmax and shits to the right side in the figure and the sheet P1 at one end tilts to the right side in the figure, the backup plate 8 is moved toward the upper roller 4U to correct the tilt of the sheet P1 and at the same time, the upper roller 4U is pressed by the sheet P1 and the contact position XU of the upper roller 4U to the sheet P1 falls in the tolerance. Further, even when the sheet P1 pushes the take-out roller 4, the contact pressure of the take-out roller 4 to the sheet P1 is always kept constant.

Figure 9:
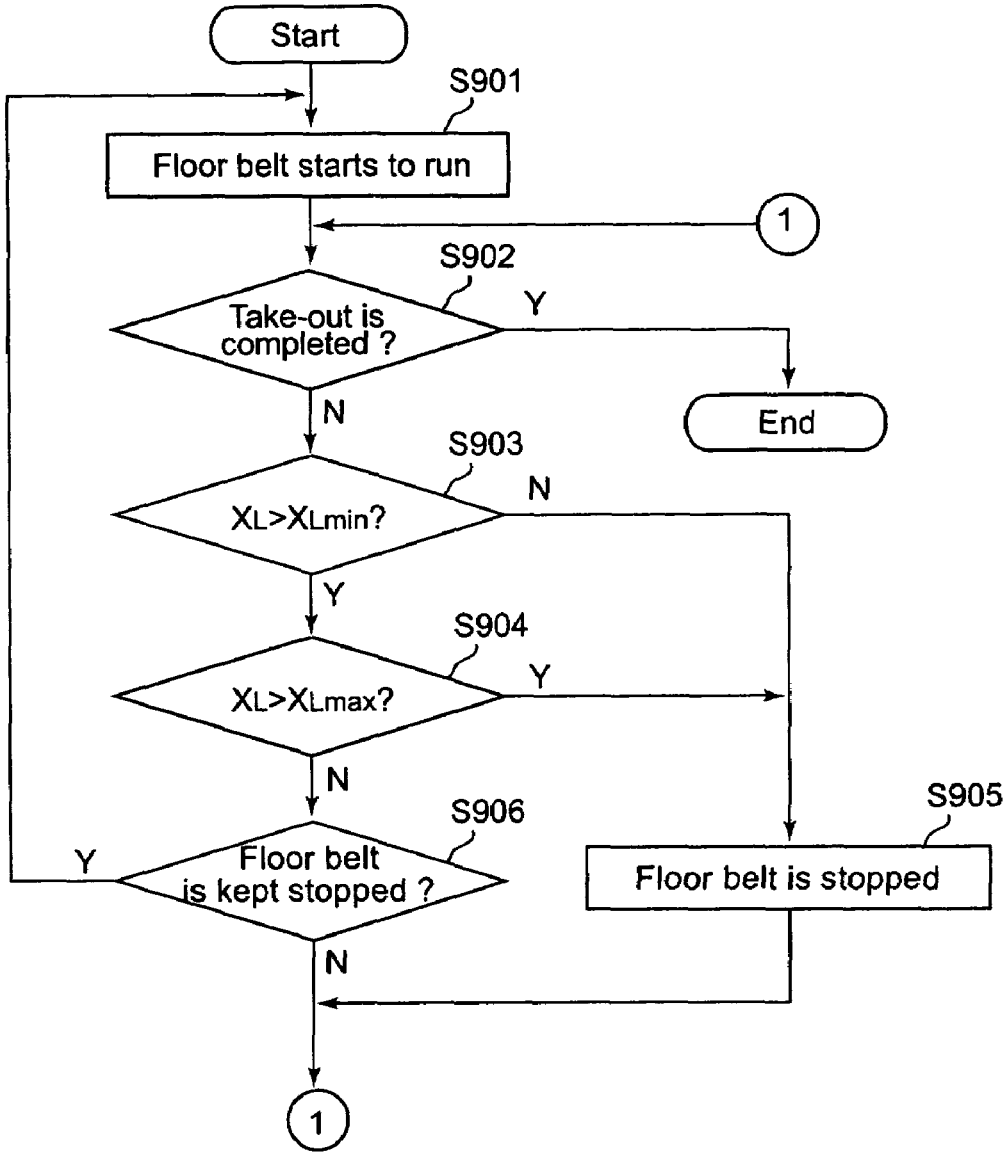
FIG. 9 is a flowchart for explaining the control operation of a floor belt of the take-out apparatus shown in FIG. 8.
Figure 10:
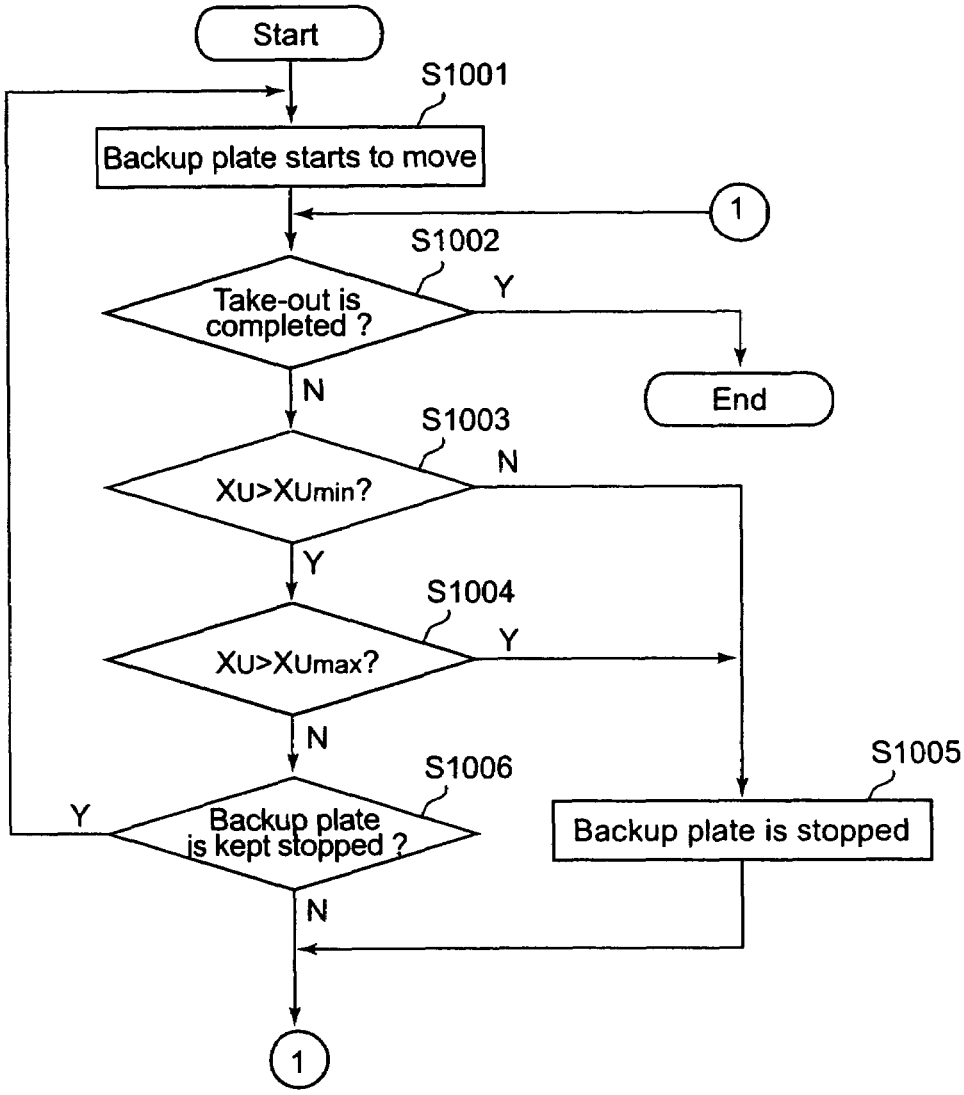
FIG. 10 is a flowchart for explaining the control operation of a backup plate of the take-out apparatus shown in FIG. 8.

Here, the operation of the take-out apparatus in the above-mentioned second embodiment will be explained referring to flowcharts shown in FIG. 9 and FIG. 10. Further, the take-out apparatus in this embodiment is in a structure wherein the take-out roller 4 is always kept pressed against the sheet P1 at a fixed pressure and therefore, it is not necessary to regulate the contact pressure by oscillating the arm 11 of the take-out roller as in the take-out apparatus in the first embodiment.

First, the control operation f the floor belt 6 will be explained referring to FIG. 9. In this embodiment, the driving of the floor belt 6 is controlled based on the contact position XL of the lower roller 4L to the sheet P1.

When a sheet P that is an object for processing is set in the stacker 2 and the power source of the take-out apparatus is turned on, the servo motor 61 is energized by the control of the motor driver 65 and the lower roller 4L and the upper roller 4U are pressed against the sheet P1 at one end in the stacking direction at a fixed pressure, respectively and the floor belt 6 starts to run (Step 901). One set of the motor driver 65 and the servomotor 61 is provided for the lower roller 4L and the upper roller 4U, respectively.

Then, the contact position XL of the lower roller 4L to the sheet P1 at one end in the stacking direction is detected based on a pulse signal output from the encoder (not shown) of the servo motor 61 for the lower roller 4L and under the condition that the operation of the take-out apparatus is not completed (Step 902; NO), this contact position XL is compared with a pre-set tolerance (XLmin to XLmax) (Steps 903 and 904). At this time, the lower limit value XLmin and the upper limit value XLmax of the tolerance are set in such a range that the end of the sheet P1 taken out by the lower roller 4L in the take-out direction is normally led in a nip between the feed roller 32 and the separation roller 34 of the separation portion 10 (not shown).

When the contact position XL of the lower roller 4L is judged to be below the lower limit value XLmin (Step 903; NO) and also judged to be within the tolerance (XLmin to XLmax) (Step 903; YES and Step 904; YES), the floor belt 6 is stopped so that a sheet P does not push the lower roller 4L (Step 905).

On the other hand, when the contact position XL of the lower roller 4L is judged to be above the upper limit value XLmax (Step 904; NO), the floor belt 6 is judged whether it is kept stopped (Step 906). If the floor belt 6 was kept stopped (Step 906; YES), the operation returns to the process in Step 901 and the running of the floor belt 6 is restarted.

On the other hand, when it is judged that the floor belt 6 is stopped in Step 905 or it is kept stopped in Step 906 (Step 906; NO), returning to the process in Step 902, the contact position XL of the lower roller 4L is again compared with the tolerance (XLmin to XLmax).

Next, the control operation of the backup plate 8 will be explained referring to FIG. 10. In this embodiment, the driving of the backup plate 8 is controlled based on the contact position XU of the upper roller 4U to the sheet P1.

First, a sheet P is set in the stacker 2, the servo motor 61 is energized by the control of the motor driver 65 and the lower roller 4L and the upper roller 4U are pressed against the sheet P1 at one end in the stacking direction and then, the backup plate 8 starts to move (Step 1001).

Then, the contact position XU of the upper roller 4U to the sheet P1 at one end in the stacking direction is detected based on a pulse signal that is output from the encoder (not shown) of the servo motor 61 for the upper roller 4U and under the condition that the operation of the take-out apparatus does not complete (Step 1002; NO), this contact position XU is compared with the pre-set tolerance (XUmin to XUmax) (Steps 1003 and 1004). At this time, the lower limit value XUmin and the upper limit value XUmax of the tolerance are set in such a range that the end in the takeout direction of the sheet P1 taken out by the upper roller 4U is normally introduced in the nip between the feed roller 32 and the separation roller 34 of the separation portion (not shown).

When the contact position XU of the upper roller 4U is judged to be below the lower limit value XUmin (Step 1003; NO) and to be within the tolerance (XUmin to XUmax) (Step 1003; YES and Step 1004; YES), the backup plate 8 is stopped so that a sheet P does not press the upper roller 4U (Step 1005).

On the other hand, when the contact position of the upper roller 4U is judged to be above the upper limit value (Step 1004; NO), the backup plate 8 is judged whether it is kept stopped (Step 1006) and when the backup plate 8 is kept stopped (Step 1006; YES), the operation returns to the process in Step 1001 and the movement of the backup plate 8 is restarted.

On the other hand, when it is judged that the backup plate 8 is stopped in Step 1005 or the backup plate 8 is judged in Step 1006 that it is kept stopped (Step 1006; NO), the operation returns to the process in Step 1002 and the contact position XU of the upper roller 4U is compared again with the tolerance (XUmin to XUmax).

As described above, according to this embodiment, in a construction simpler than the take-out apparatus 1 in the first embodiment, it is possible to maintain the contact pressure of the take-out roller 4 to the sheet P1 always constant and achieve the same effect as the first embodiment. Further, the control operation is extremely easy without necessity for controlling the driving of the arm 11, the floor belt 6, the backup plate 8, etc. by monitoring the contact pressure of the take-out roller 4.

Further, the pressing mechanism for pressing the take-out roller 4 against the sheet P1 at a fixed pressure is not restricted to the above-mentioned pressing mechanism 60 in the second embodiment but can be in any construction.

Figure 11:
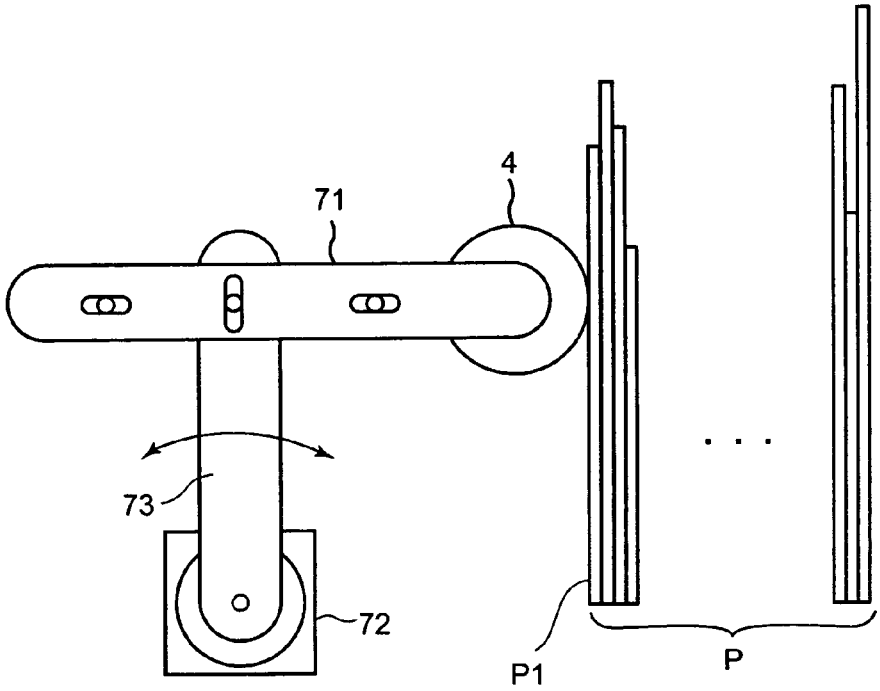
FIG. 11 is a plan view showing a deformed example of a pressing mechanism of the take-out apparatus shown in FIG. 8.
Figure 12:
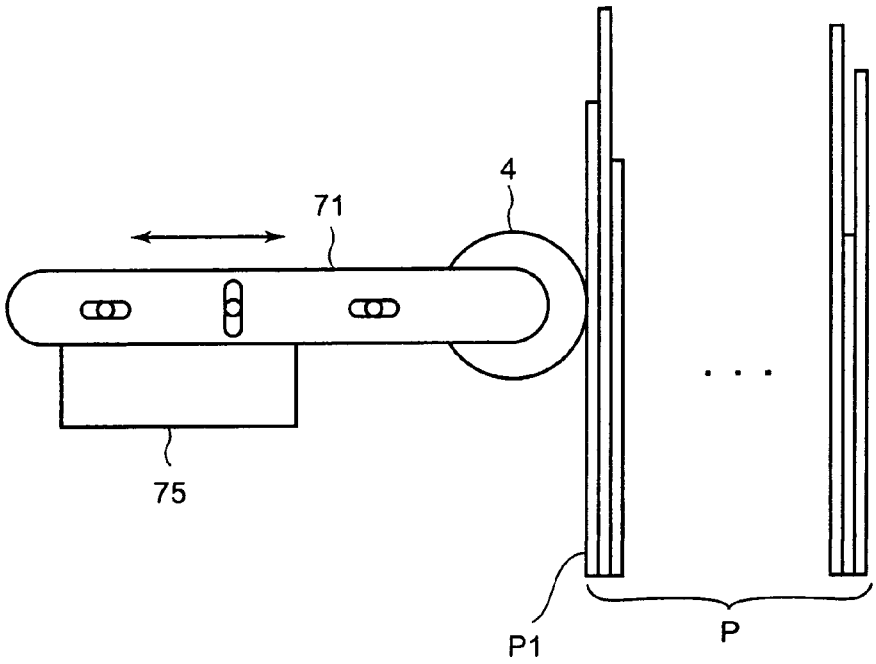
FIG. 12 is a plan view showing another deformed example of the pressing mechanism of the take-out apparatus shown in FIG. 8.

For example, as shown in FIG. 11, install the arm 11 with the take-out roller 4 rotatably attached to the end enabling to slide along the stacking direction of sheets P and connect the end of a motor arm 73 attached to a torque control servo motor 72 to the middle portion of an arm 71. The take-out roller 4 can be pressed against the sheet P1 at a fixed pressure by outputting a fixed torque via the servomotor 72 so as to directly move the arm 71. Further, for example, the arm 71 may be slid in the stacking direction using a torque control linear motor 75 instead of the servomotor as shown in FIG. 12. Further, another torque generating source such as an air actuator, etc. using air pressure may be adopted for the linear motor 75.

Further, in the above-mentioned first and second embodiments, a case is explained, wherein a sheet P is moved by operating the floor belt 6 and the backup plate 8, but the floor belt 6 is not an indispensable structural element and at least a backup plate 8 is sufficient if available.

Figure 13:
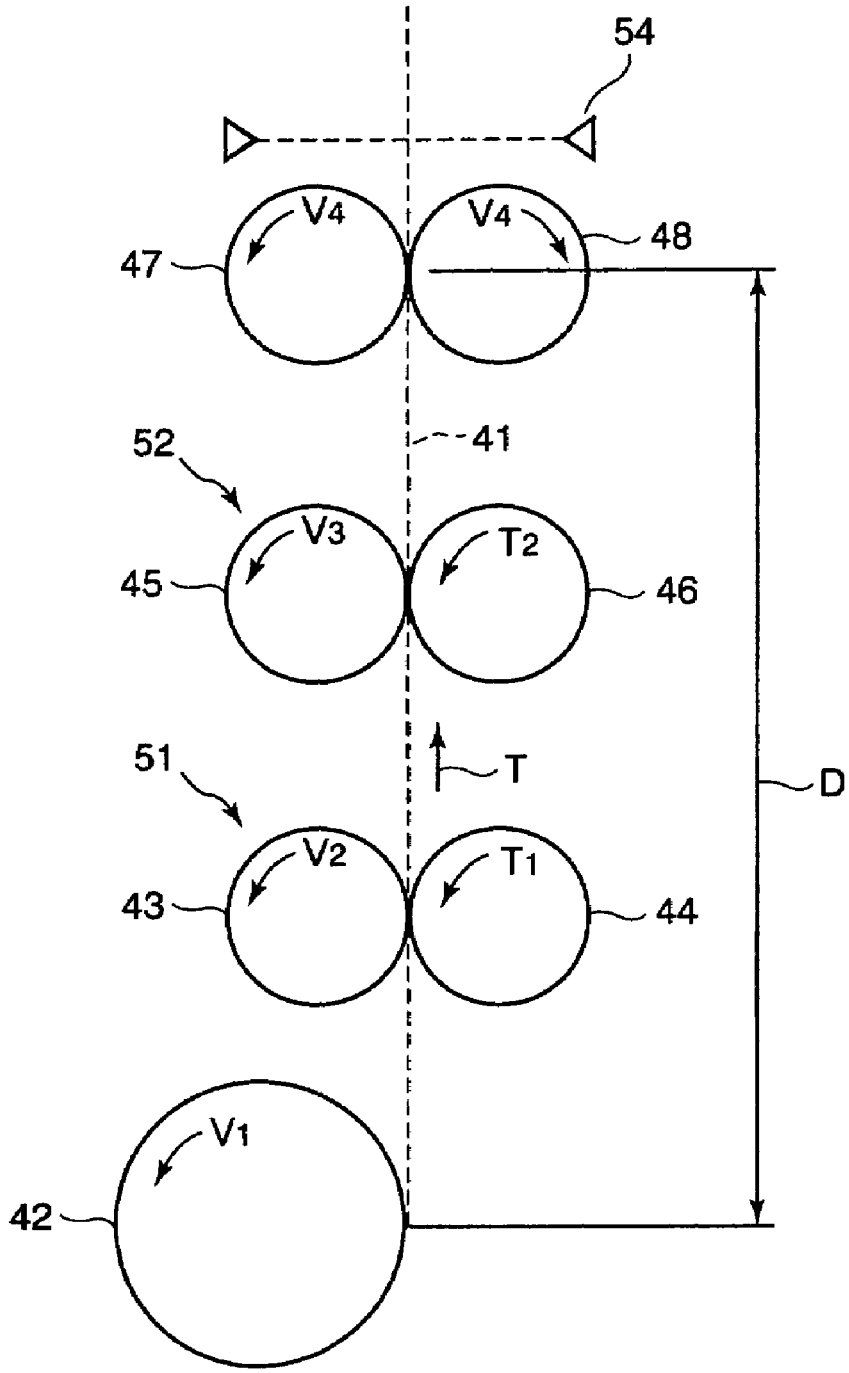
FIG. 13 is a schematic diagram showing a third embodiment of the take-out apparatus of the present invention and its essential construction.

Next, the take-out apparatus in a third embodiment of the present invention will be explained referring to FIG. 13. This take-out apparatus is almost in the same structure as the take-out apparatus 1 in the first embodiment described above. The structure of essential components only is illustrated here and illustrations of other component elements are omitted. Further, the rollers illustrated here are composed of two rollers that are separated each other in the axial direction.

This take-out apparatus has a take-out roller 42 to take out sheets on a conveying path 41 by rotating in contact with a sheet (not shown) at one end in the stacking direction out of those stacked in the erected state in the stacker (not shown). The take-out roller 42 functions to rotate at a velocity V1 (a first velocity) along the sheet conveying direction (the arrow direction T in the figure) (a first direction) and take out sheets at one end in the stacking direction sequentially one by one on the conveying path 41.

On the conveying path 41 at the downstream side from the take-out roller 42 along the conveying direction T, there is arranged a first separation portion 51 comprising a feed roller 43 (a first feed roller) that rotates at a velocity V2 along the conveying direction in contact with a sheet taken out on the conveying path 41 and a separation roller 44 (a first separation roller) arranged opposing to the feed roller 43 through the conveying path 41. The feed roller 43 is arranged at the same side of the take-out roller 42, that is, at the left side to the conveying path 41 in the figure. The separation roller 44 functions to separate a second and subsequent sheets taken out in the overlapped state with a first sheet taken out on the conveying path 41 by giving a tangential force F1 (a first tangential force) in the direction (a second direction) reverse to the conveying direction.

On the conveying path 41 at the downstream side from the first separation portion 51 along the conveying direction T, a second separation portion 52 is arranged. The second separation portion 52 has a feed roller 45 (a second feed roller) that rotates at velocity V3 (a third velocity) along the conveying direction in contact with a sheet passed through the first separation portion 51 from the left side of the conveying path 41 and a second separation roller 46 (a second separation roller) arranged opposing to the feed roller 45 through the conveying path 41. The separation roller 46 functions to separate the second and subsequent sheets taken out in overlapped with the first sheet passed the first separation portion 51 without separated by giving tangential force F2 (a second tangential force) in the direction reverse to the conveying direction T.

Further, the rotating velocities of the take-out roller 42, the feed roller 43 and the feed roller 45 are set at velocities to satisfy the following formula:

$$V1 \leqq V2 \leqq V3$$

Thus, by setting the rotating velocities of the rollers 42, 43 and 45 at least at the same or gradually decreasing levels, the generation of sag in sheets between the rollers can be prevented.

Further, the tangential force F1 and tangential force F2 are set at a level to satisfy the following formula:

$$F1 > F2$$

On the conveying path 41 at the downstream side from the second separation portion 52 along the conveying direction T, there is arranged a pull out roller pair 47 and 48 opposing to each other at a prescribed pressure through the conveying path 41. The pull out roller pair 47 and 48 rotates at a velocity V4 at least faster than the velocities V1 to V3 along the conveying direction T, receives the end of the sheet in the nip of the pull out roller pair 47 and 48 and pulls out the sheet from the second separation portion 52.

Further, the pull out roller pair 47 and 48 is arranged at the positions where a distance D from a position of the take-out roller 42 to a sheet at the end to the nip of the pull out roller pair 47 and 48 becomes longer than the most long length Lmax of sheets processed by the take-out apparatus. Thus, as the rear end of even the most long sheet is away from the take-out roller 42 when its front end is led into the nip of the pull out roller pair 47 and 48, the take-out roller 42 can be prevented from leaping up when a sheet is pulled out rapidly by the pull-out roller pair 47 and 48.

On the contrary, when the distance D from the take-out roller 42 to the pull-out roller pair 47 and 48 is shorter than a sheet, the rear end of the sheet beats up the take-out roller 42 when the sheet is pulled out by the pull-out roller pair 47 and 48 and a timing of a succeeding sheet to contact the take-out roller is delayed. As a result, a gap between two sheets becomes longer than an intended gap.

The take-out apparatus in the above-mentioned structure operates as shown below.

First, the take-out roller 42 is rotated at the velocity V1 and a sheet stacked in the stacker at one end in the stacking direction is taken out on the conveying path 41. At this time, a second and subsequent sheets overlapped on a first sheet may be taken out on the conveying path 41 in some cases.

The sheet taken out on the conveying path 41 is passed through the first or the second separation portions 51 and 52 and separated one by one in the first or the second separation portion 51 or 52. The front end of the sheet passed through the second separation portion 52 is brought into the nip of the pull out roller pair 47 and 48, pulled out by the pull out roller pair 47 and 48 and conveyed to the processing portion at the latter stage on the conveying path 41.

As described above, according to the take-out apparatus in this embodiment, two separation portions 51 and 52 are arranged along the conveying path 41, it is not necessary to set a separation tangential force in the reverse direction at a higher level as in the above-mentioned conventional apparatus that has only one separation portion, and the tangential forces F1 and F2 in the reverse direction for separating plural sheets can be set rather low in the separation portions 51 and 52. Thus, a friction force generated between the separation rollers 44 and 46 of the separation portion 51 and 52 and sheets when pulling out sheets by the pull out roller pair 47 and 48 can be made small and a serious contamination and damage can be prevented from generating on sheets.

Further, the tangential force F2 in the reverse direction of the separation roller 46 of the second separation portion 52 close to the pull out roller pair 47 and 48 is made smaller than the tangential force F1 of the separation roller 44 at the upper stream side far away from the pull out roller pair 47 and 48 and therefore, a pull out force of sheets by the pull out roller pair 47 and 48 could be made small and the processing capacity could be improved. On the contrary, the separation capacity in the second separation portion 52 becomes low as the tangential force F2 of the separation roller 46 at the downstream side is made small. However, because sheets passed through the first separation portion 51 are exposed at least in the state of sliced raw fish, the defective sheet separation is produced in the second separation portion 52.

By the way, in this type of take-out apparatus, in order to promote the processing efficiency in the processing portion at the latter stage, it is preferred to make a gap (a conveying interval) between two sheets continuously conveyed on the conveying path 41 almost constant for all sheets to be conveyed. For example, it is desirable to adjust a gap between all sheets to the minimum gap that is in time for actuating a gate provided on the conveying path 41.

In the take-out apparatus in this embodiment, a gap between sheets conveyed to the processing portion at the latter stage by the pull out roller pair 47 and 48 is formed by providing a difference for the conveyance of sheets before and after the pull out roller pair 47 and 48 at least by making the rotating velocity V4 of the pull out roller pair 47 and 48 faster than the rotating velocities V1, V2 and V3 of the other rollers 42, 43 and 45. That is, a gap is formed between two continuously conveying sheets when a preceding sheet is conveyed at the most fast velocity V4 before a succeeding sheet reaches the nip of the pull out roller pair 47 and 48.

In the case of the above-mentioned conventional take-out apparatus that has only one separation portion and when two overlapped sheets are separated in the second separation portion 52 in this embodiment, the front end in the conveying direction of a succeeding sheet is led into the nip of the second separation portion 52 immediately after the rear end in the conveying direction of a preceding sheet passed the nip of the second separation portion 52. Therefore, a gap between two sheets depends on the rotating velocity V3 of the feed roller 45 of the second separation portion 52, the rotating velocity V4 of the pull out roller pair 47 and 48, and a distance from the nip of the second separation portion 52 and the nip between the pull out roller pair 47 and 48 and becomes almost constant.

However, when two sheets in the overlapped state are separated in the first separation portion 1 of the take-out apparatus in this embodiment and when sheets immediately after taken out by the take-out roller 42 are not overlapped, a time after two sheets are separated until the front end of a succeeding sheet is led into the nip of the pull out roller pair 47 and 48 becomes long and a gap between sheets becomes long accordingly.

Therefore, in this embodiment, a sensor 54 is provided on the conveying path 41 at the downstream side from the pull out roller pair 47 and 48, and by detecting a gap between sheets from a timing of the sheets to pass this sensor 54, this gap is adjusted to a desired value. That is, by setting velocities V1 to V4 in advance so that a gap between sheets taken out on the conveying path 41 by the pull out roller pair 47 and 48 becomes smaller than a desired value, the gap between sheets is adjusted by delaying the conveyance of a succeeding sheet of two sheets having a gap that becomes smaller than the desired value.

To be concrete, a gap between two sheets successively taken out is detected from a time after the rear end of a preceding sheet of the two sheets passed the sensor 54 until the front end of a succeeding sheet reaches the sensor 54 and the succeeding sheet is kept stopped for a prescribed time or decelerated so that the gap (pre-set at a value smaller than a desired value) becomes a desired value. In this case, the operation of at least one of the rollers 43, 45, 47 and 48 that are clamping the succeeding sheet is controlled to decelerate in a moment or stopped for a prescribed time.

As described above, according to this embodiment, two separation portions 51 and 52 are provided along the conveying path 41 and all sheets can be separated and conveyed certainly without generating contamination and/or damage of sheets. Further, a distance D from the take-out roller 42 to the pull out roller pair 47 and 48 is extended longer than the length Lmax of a most long sheet and therefore, the leap-up of the take-out roller 42 can be prevented when sheets are pull out by the pull out roller pair 47 and 48 and a gap can be formed at a desired value.

Further, in this embodiment a gap is adjusted in a moment by detecting a gap between sheets through the sensor 54 provided at the downstream side of the pull out roller pair 47 and 48 and therefore, even when two separation portions 51 and 52 are arranged along the conveying path 41, it becomes possible to keep a gap between sheets constant.

Further, the present invention is not limited to the above-mentioned embodiments but can be changed or modified variously without departing from the scope of the invention. For example, in the above-mentioned embodiments, the structure with two separation portions 51 and 52 provided along the conveying path 41 are explained but not restricted to that structure but three or more separation portions may be provided on the conveying path 41.

Figure 14:
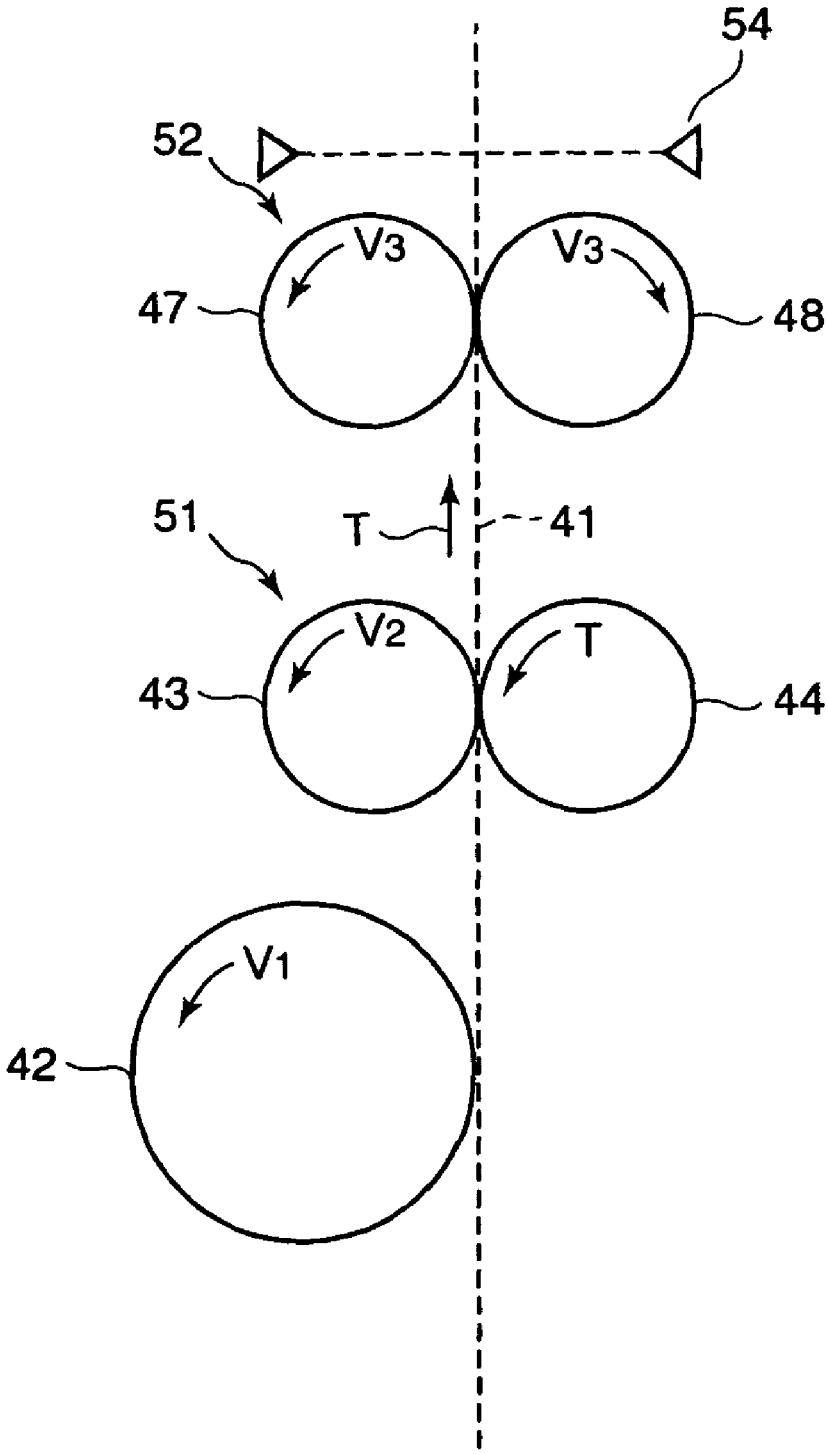
FIG. 14 is a schematic diagram showing a deformed example of the take-out apparatus shown in FIG. 13.

On the contrary, only one separation portion 51 may be arranged on the conveying path 41 as shown in FIG. 14. That is, the take-out apparatus may be in a structure with the second separation portion 52 in the third embodiment omitted.

In this case, for example, even if the front end in the take-out direction of a sheet taken out by the take-out roller 42 did not normally led into the nip of the first separation portion 51 and the conveyance was delayed or if a slip was caused between the take-out roller 42 and a sheet, it is sufficient to control the rotation of the rollers so as to accelerate the sheet by detecting an actual gap through the sensor 54. That is, when the speed control of the present invention is adopted, it is possible to correct a gap between sheets that are taken out in any state accurately to a desired value.

Figure 15:
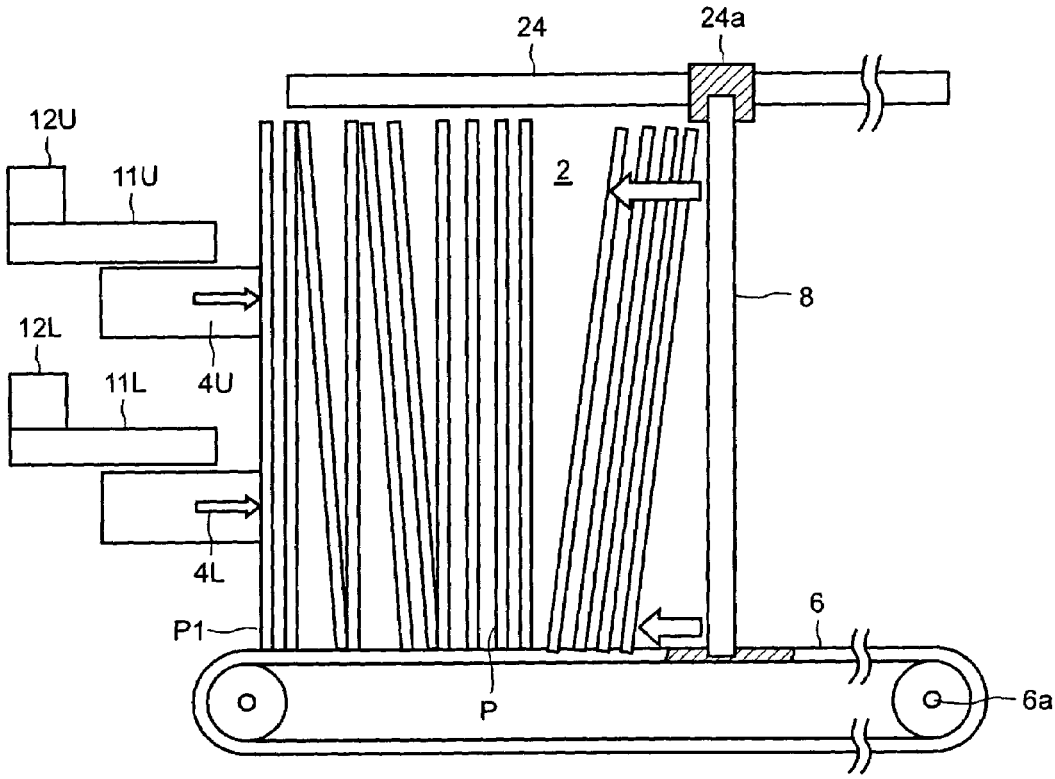
FIG. 15 is a partially sectional fragmentary front view of the backup plate showing the state mounted to the floor belt.

Further, in the above-mentioned embodiments, the floor belt 6 and the backup plate 8 are driven by an independent driving system. But not restricted to this, the lower end of the backup plate 8 can be attached to the floor belt 6 and its upper end may be fixed to a supporting member 24*a* attached movably to the rail 24 and the backup plate 8 can be moved simultaneously with the movement of the floor belt 6 as shown in FIG. 15. In this case, the motor 26 for driving the backup plate 8 that is explained in the first embodiment becomes unnecessary.

Further, a case to control a gap between sheets is explained in the third embodiment but a pitch of sheet may be controlled to a fixed level as a conveying interval of sheets. In this case, it is only required to adjust a time after the front end of a preceding sheet passed the sensor 54 and the front end of a succeeding sheet passes the sensor 54 to a constant level.

As explained above, the sheet take-out apparatus of the present invention is in the structure and has actions as described above, and is capable of taking out sheets in the stacked state stably and certainly, feeding them by separating one by one and keeping the conveying intervals of sheets constant.

What is claimed is:

1. A sheet take-out apparatus comprising:

a supply mechanism to move sheets in a stacked state to a take-out position where the sheets are moved in the forefront in turn;

at least one take-out roller which contacts a forefront sheet in the stacked state and rotates to take out the forefront sheet moved to the take-out position;

a pressing mechanism which presses the at least one take-out roller against the forefront sheet at the take-out position constantly at a fixed pressure;

at least one pressure sensor to detect a contact pressure of the at least one take-out roller to contact the forefront sheet at the take-out position, and wherein the pressing mechanism includes:

at least one supporting member mounting the at least one take-out roller rotatably;

at least one motor to contact and to separate the at least one take-out roller to and from the forefront sheet at the take-out position by moving the supporting member; and at least one motor driver to energize the at least one motor to press the at least one take-out roller against the sheets in the stacked state, and wherein the at least one motor driver is controlled in response to the contact pressure detected by the at least one pressure sensor;

wherein the supply mechanism includes a stacker to stack at least the forefront sheet and a second sheet in an erected state, and wherein the at least one take-out roller includes a lower roller arranged in contact with a lower portion of the forefront sheet in the stacker and an upper roller arranged in contact with an upper portion of the forefront sheet, to take-out the forefront sheet in a horizontal direction by rotating the lower and upper rollers, wherein, the apparatus further comprises:

a floor belt supporting the forefront and second sheets stacked in the stacker by contacting the lower ends of the forefront and second sheets;

a first moving mechanism to move the forefront and second sheets toward the at least one take-out roller by running the floor belt;

a backup plate that contacts an upper portion of the second sheet stacked in the stacker; and a second moving mechanism to move the forefront and second sheets toward the at least one take-out roller by moving the backup plate, wherein the pressing mechanism includes:

a first pressing mechanism to press the lower roller against the forefront sheet constantly at a first fixed pressure, and a second pressing mechanism to press the upper roller against the forefront sheet constantly at a second fixed pressure.

2. A sheet take-out apparatus comprising:

a supply mechanism to move sheets in a stacked state to a take-out position where the sheets are moved in the forefront in turn;

at least one take-out roller which contacts a forefront sheet in the stacked state and rotates to take out the forefront sheet moved to the take-out position;

a pressing mechanism which presses the at least one take-out roller against the forefront sheet at the take-out position constantly at a fixed pressure, the pressing mechanism including a supporting member mounting the at least one take-out roller rotatably, a motor to contact and to separate the at least one take-out roller to and from the forefront sheet at the take-out position by moving the supporting member, and a motor driver to energize the at least one motor to press the at least one take-out roller against the sheets in the stacked state;

wherein the supply mechanism includes a stacker to stack at least the forefront and a second sheet in an erected state, and wherein the at least one take-out roller includes a lower roller arranged in contact with a lower portion of the forefront sheet in the stacker and an upper roller arranged in contact with an upper portion of the forefront sheet, to take-out the forefront sheet in a horizontal direction by rotating the lower and upper rollers, a floor belt supporting the forefront and second sheets stacked in the stacker by contacting the lower ends of the forefront and second sheets;

a first moving mechanism to move the forefront and second sheets toward the at least one take-out roller by running the floor belt;

a backup plate that contacts an upper portion of the second sheet stacked in the stacker;

a second moving mechanism to move the forefront and second sheets toward the at least one take-out roller by moving the backup plate;

a first sensor to detect a contact position of the lower roller contacting the forefront sheet;

a second sensor to detect a contact position of the upper roller contacting the forefront sheet; and a controller to actuate the first moving mechanism to run the floor belt according to the result of detection by the first sensor, and actuate the second moving mechanism to move the backup plate according to the result of detection by the second sensor, wherein the pressing mechanism includes a first pressing mechanism to press the lower roller against the forefront sheet constantly at a first fixed pressure, and a second pressing mechanism to press the upper roller against the forefront sheet constantly at a second fixed pressure.

3. A sheet take-out apparatus comprising:

a supply mechanism to move sheets in a stacked state to a take-out position where the sheets are moved in the forefront in turn;

at least one take-out roller which contacts a forefront sheet in the stacked state and rotates to take out the forefront sheet moved to the take-out position;

a pressing mechanism which presses the at least one take-out roller against the forefront sheet at the take-out position constantly at a fixed pressure, the pressing mechanism including at least one supporting member mounting the at least one take-out roller rotatably, at least one motor to contact and to separate the at least one take-out roller to and from the forefront sheet at the take-out position by moving the supporting member, and at least one motor driver to energize the motor to press the at least one take-out roller against the sheets in the stacked state, wherein the supply mechanism includes a stacker to stack sheets in an erected state, and wherein the at least one take out roller includes a lower roller arranged in contact with a lower portion of the forefront sheet in the stacker and an upper roller arranged in contact with the an portion of the forefront sheet, to take-out the forefront sheet in a horizontal direction by rotating of the lower and upper rollers, a floor belt supporting the sheets stacked in the stacker by contacting the lower end of the forefront sheet;

a first moving mechanism to move the sheets toward the upper and lower rollers by running the floor belt;

a backup plate that contacts an upper portion of a backmost sheet in the stacker; and a second moving mechanism to move the sheets toward the upper and lower rollers by moving the backup plate, wherein the pressing mechanism includes:

a first pressure sensor to detect a first contact pressure of the lower roller to contact the forefront sheet, a second pressure sensor to detect a second contact pressure of the upper roller to contact the forefront sheet, and a controller to control the first and the second contact pressure to a proper value, respectively by controlling the first moving mechanism based on the result of detection of the first pressure sensor and the second moving mechanism based on the result of detection of the second pressure sensor.

4. The sheet take-out apparatus according to claim 3, wherein the controller controls the first moving mechanism so as to run the floor belt toward the lower roller when the first contact pressure is lower than the second contact pressure and the first contact pressure is not above a tolerance.

5. The sheet take-out apparatus according to claim 3, wherein the controller controls the second moving mechanism so as to move the backup plate toward the upper roller when the second contact pressure is lower than the first contact pressure and the second contact pressure is not above a tolerance.

* * * * *